United States Patent [19]

Bihy et al.

[11] Patent Number: 4,866,905

[45] Date of Patent: Sep. 19, 1989

[54] METHOD OF INSTALLING A MINERAL FIBRE MATERIAL PROVIDED IN ROLL FORM, A MINERAL FIBRE STRIP SUITABLE FOR CARRYING OUT THE METHOD AND A METHOD OF PRODUCING THE MINERAL FIBRE STRIP

[75] Inventors: Lothar Bihy, Kaiserslautern; Jurgen Royar; Frank Ruechel, both of Ladenburg; Reinhard Stoyke, Dudenhofen, all of Fed. Rep. of Germany

[73] Assignee: Isover Saint-Gobain, Courbevoie, France

[21] Appl. No.: 35,863

[22] Filed: Apr. 8, 1987

[30] Foreign Application Priority Data

Apr. 16, 1986 [DE] Fed. Rep. of Germany ..... 3612858
Apr. 16, 1986 [DE] Fed. Rep. of Germany ..... 3612857

[51] Int. Cl.[4] ..... E04B 1/74; E04D 13/16; E04C 2/16

[52] U.S. Cl. ..... 52/743; 52/404; 52/105

[58] Field of Search ..... 52/743, 404, 406, 407, 52/747, 105; 206/417

[56] References Cited

U.S. PATENT DOCUMENTS

| | | | |
|---|---|---|---|
| 2,270,419 | 1/1942 | Debo | 52/105 |
| 3,527,004 | 9/1970 | Sorensen | 52/105 |
| 3,541,745 | 11/1970 | Probst | 52/105 |
| 3,835,604 | 9/1974 | Hoffmann | 52/404 |
| 3,958,385 | 5/1976 | Bondra et al. . | |
| 4,384,437 | 5/1983 | Coles | 52/404 |
| 4,637,188 | 1/1987 | Crothers | 52/404 |

FOREIGN PATENT DOCUMENTS

| | | | |
|---|---|---|---|
| 0075187 | 4/1986 | European Pat. Off. . | |
| 0101376 | 12/1986 | European Pat. Off. . | |
| 846561 | 9/1939 | France | 52/404 |
| 8202553 | 2/1983 | Netherlands | 52/404 |
| 1037119 | 8/1964 | United Kingdom . | |

OTHER PUBLICATIONS

Sweet's Catalog File 1985, 7.14/OW pages 1, 4, 5.
Combles Amenageables Charpente Irreguliere.
G+H Isover Rollisol-SB Brochure.

*Primary Examiner*—John E. Murtagh
*Attorney, Agent, or Firm*—Oblon, Spivak, McClelland, Maier & Neustadt

[57] ABSTRACT

From a mineral fibre strip supplied in roll form, portions (L) are cut off, the length of which corresponds to the width of a rafter area between rafters plus an oversize designed to produce a clamping effect. Formed in this way, the mineral fibre panels are so inserted into the rafter area that the lateral edges of the mineral fibre strip form the top edge and the bottom edge of the panels. In this way, it is possible to achieve virtually completely wastage-free roof insulation even when the distances between the roof rafters vary considerably, and it is possible to work with material of one uniform and considerable width which is supplied in the form of rolls. By reason of the considerable width of the mineral fibre strip, insulation of one rafter area over its entire length requires only a few mineral fibre panels, with few joints being produced. To facilitate guidance of the cut for separating the portions (L), it is possible to provide on one side of the mineral fiber strip marking lines which can, during production, be generated by a co-rotating roller having linear heated zones.

8 Claims, 3 Drawing Sheets

METHOD OF INSTALLING A MINERAL FIBRE MATERIAL PROVIDED IN ROLL FORM, A MINERAL FIBRE STRIP SUITABLE FOR CARRYING OUT THE METHOD AND A METHOD OF PRODUCING THE MINERAL FIBRE STRIP

BACKGROUND OF THE INVENTION

1. Field of the Invention:

The invention relates to a method of installing mineral fibre material containing a binder and provided in roll form in an elongated installation space bounded by lateral supports, particularly an area between two roofing spars or rafters, and also to a mineral fibre strip suitable for carrying out the method and a method of producing such a mineral fibre strip.

2. Discussion of Background Art

When insulating the space between rafters with mineral fibre material, one essential difficulty is that the strip or panel-shaped prefabricated mineral fibre material has to be manufactured and made available in clearly defined widths, but the distances between the rafters may, however, vary from one building site to another, and frequently—particularly in old buildings—even from one area of the rafters to another or even within the same area of the rafters. The mineral fibre material must be installed with a certain pressure between the rafters which is sufficiently great to avoid gaps along the edges, to prevent cold bridges and convection, and to achieve a retaining effect. On the other hand, the pressure should not be so great as to produce bulging of the material, which might unintentionally close off the rear ventilation gap and defeat the desired formation of a flat inside face to the insulation. Depending on the compressibility of the mineral fibre material, therefore, the oversize when installing should be in the range between 1 and 5 cm.

DE-OS No. 32 29 601 discloses a sheet of insulating material which permits proper installation even by inexperienced installers and substantially facilitates adaptation to the particular rafter width involved. Since this insulating material has no functional disadvantages compared with a normally fitting insulating material, either in installation or in effect, it has become commercially popular. Facilitation of fitting resides in the fact that there are in the lateral marginal zones of the layer of insulant differently colored marking lines which do not actually weaken the layer of insulant, being only visually identifiable, but which define modular marginal strips which can be cut off for adaptation to the relevant rafter width. Therefore, the user need only select the marking lines at which a cut is to be made, place a cutting aid between the layer of insulant and the lining and without any further aids such as a straight edge or the like, cut along the given marking line in a single stroke, needing only to ensure that the knife follows the marking line. However, it is always a disadvantage that cutting the insulating material to suit the desired rafter width will necessarily result in wastage.

To avoid wastage, it is also known, for example from DE-OS No. 32 03 624, to depart from a rectangular panel or strip shape and to use instead wedge-shaped insulating panels which are constructed, for instance, like a triangle. These wedge-shaped panels should be produced so as to be slightly undersized, installed individually between the rafters and wedged therein against adjacent panels which are fitted the other way around so that the desired pressure of contact is achieved.

Wedging panels against one another in the area between the rafters does, however, create practical difficulties in the case of mineral fibre material because the spreading-apart wedging effect which must be achieved with such panels presupposes the panels sliding on the oblique surfaces of adjacent panels, but the consistency of mineral wool only allows this to occur to an extremely limited extent, if at all. Furthermore, if the triangular geometric height of the triangular panel (which runs at a right-angle to the longitudinal extension of the rafter area) does not happen to correspond to the distance between the rafters, then there is the further difficulty that a laterally projecting tip of one wedge of insulating material will be squashed on the rafter while an upwardly projecting tip will be squashed against the bottom of a panel. This results in localized accumulations of material which disturb the mutual contact between panel elements and will inevitably lead to gaps between adjacent panel edges, which will in turn produce cold bridges and convection. To avoid large projecting tips and the resulting gaps, its necessary to make available a multiplicity of nominal panel widths, which leaves the situation unchanged.

A further essential disadvantage of this method lies in the fact that the wedge-shaped mineral fibre panels must be packaged and delivered in stacks and cannot be rolled up. Mineral fibre strips which are stored and delivered in the form of rolls offer the advantage of considerably reduced space for transport and storage. Since the mineral fibre material is greatly compressed in the roll, and by reason of the pressure which takes effect in the roll shape, the material can be compressed without any localized irreversible squashing. With such mass produced items of low raw density, a reduction of, for example, a half in transport and storage volume provides quite perceptible cost advantages, and correspondingly saves on packaging material. Therefore, every attempt should be made to find a procedure by which the mineral fibre material can be packaged and delivered in roll form.

SUMMARY OF THE INVENTION

Adopting as a premise the procedure disclosed in DE-OS No. 32 29 601, in which the mineral fibre material is made available in roll form, it is the object of the invention to provide a method of installing mineral fibre material, for example in the area of rafters, wherein wastage during installation is minimized or entirely avoided, while making it possible to entirely dispense with manufacturing and stock-keeping of mineral fibre material in different nominal widths and without any substantially increased labor costs during installation.

Cutting losses can be completely avoided by a "transverse installation" of length portions cut from the roll, since the width of the strip, which can be maximized from the manufacturing aspect, extends in the longitudinal direction of the rafter area, and the width of each rafter area is directly taken into account by a single separating cut, by which a longitudinal portion is cut from the strip of mineral fibre in order to form a mineral fibre panel which is ready to be installed. If the roll is made available in a single width, for example 1200 mm, then a few straight cuts will be sufficient to produce a necessary number of mineral fibre panels to fill the rafter area and to ensure the required fit for a clean fit between the rafters. With a corresponding adaptation of the oversize provided at the time of cutting to suit the compressibility of the mineral fibre material, it is sufficient simply to push each panel snugly between the rafters for the panel to remain there without any further retaining means, a gap from the adjacent panel being closed up simply by pushing the most recently installed portion. The end panel in the ridge area can be cut off if it is overlong, and the cut off end can be installed in another rafter area of appropriate width, so that there is no wastage even at the ends of the rafter area.

Compared with the prior art procedure, therefore, despite the fact that the mineral fibre material is supplied in only a single nominal width, there is a further considerable reduction in wastage, generally close to nil. Furthermore, it is possible to favorably work with material from the roll and the labor cost involved in installation is considerably reduced by the substantially larger panel areas, although each panel can nevertheless easily be handled by a single person and because, in spite of the size, the insulating material fits between the rafters as if it were cut to size. Furthermore, the number of joints between the panels, which are not in themselves desirable if one adopts the premise of filling the entire rafter area with as few joints as possible in order to overcome any possible weak points, can be considerably reduced. Since only a few transverse joints occur in any rafter area, and by virtue of the fact that the panels lie flat in the rafter area, any gaps can be reliably closed by pushing the panels up against one another.

By reason of the considerable width of the rolls of insulating material made available and considering the rolls to be 5 m or more in length and allowing for the avoidance of any wastage through cutting, one roll can on average be used to insulate two rafter areas, i.e. the space between any three rafters. Therefore, less importance attaches to the fact that as a rule, the last remaining portion in a roll, which produces too small a panel width, can only be used for some other purpose after it has been cut to size, so that there must be wastage. However, the method of the invention avoids any wastage even at the end of the roll, since the insufficient width of a portion left over at the end of one roll can be made up by taking a correspondingly narrow portion from the beginning of the next roll so that these two portions can be used to make up a two-part panel of the desired size and without any wastage. The only peculiarity in such a panel is a vertical joint in the rafter area and this will occur, for instance, in every second or third area between rafters.

If the height of the rafter area does not correspond to an whole multiple of the height of the mineral fibre panels—corresponding to the width of the mineral fibre strip, the last mineral fibre panel to be installed projects over the rafter area in the roof ridge area. To avoid cuttings or waste in this situation, it is provided that the projecting part of the mineral fibre panel is cut off so that the remaining part of the mineral fibre panel still fits into the roof ridge area, while the cut off part is used as a beginning panel of reduced height for filling the next rafter area to be filled. In this way, only a very minimum waste occurs when the last rafter area is filled; in other words, there is no use for the cut-off part of the mineral fibre panel for the beginning of the installation in a following rafter area, but such a small amount of cut mineral fibre material can easily be used for other fillings.

Since a lining on the mineral fibre strip has to be cut through at the same time when the individual panels are formed, after which the transverse joints between the linings in the rafter area and also the edges of the lining have to be closed up at the rafters, it is preferable to use unlined mineral fibre material and, if a vapor barrier is required, it is installed after the mineral fibre panels have been laid, the lining being laid to cover the individual mineral fibre panels and possibly also the rafter area, as is already known per se. This cuts the cost of closing up to that of sealing at long joints between individual strips, the joints being moreover more readily accessible as a result.

A mineral fibre sheet which is particularly suitable for carrying out the method has marking lines which serve as a cutting aid and which are differently colored, being only visually effective and not weakening the mineral fibre material. Thus, the marking lines have no effect on the ease of handling or efficiency of the mineral fibre material. In contrast to the teaching according to DE-OS No. 32 29 601, the marking lines are set transversely to the length of the mineral fibre strip. In this way, they lie parallel with the cutting direction envisaged within the method according to the invention.

In this respect, the marking lines can be equidistant from one another, being for example 100 mm apart. Adjusting different distances which in the case of DE-OS No. 32 29 601 may be a good idea, does not in this case afford any advantages since the location of the cut is completely undefined during production. A series of parallel lines spaced apart by the same relatively small amount makes it possible to maintain one direction of cut even without a straight edge, purely by eye, so that once the location of the cut has been established, the cut can be made freehand without any further preparation, and in parallel with the nearest line.

Whereas the wedging effect strived for according to DE-OS No. 32 03 624 is less attainable with lighter mineral fibre material used, there is no such restriction to using relatively heavy and dense material within the framework of the invention. This makes a further contribution to a saving of material; a crude density between 10 and 30 kg/cu.m and in particular between 14 and 25 kg/cu.m is preferred, the bottom range of crude density for mineral fibre material of heat conductivity group 040 and the upper range for material in heat conductivity group 035 being particularly suitable.

Whereas the crude densities correspond substantially to the crude densities of the mineral fibre strip of DE-OS No. 32 03 601, the binder content can be somewhat higher, between about 6 and 7% by weight of dry binder in the product, the lesser content of binder in accordance with the indicated range applying to material of heat conductivity group 035 while the higher binder content applies to material in heat conductivity group 040. By reason of the somewhat increased binder content, there is a rather greater stiffness and thus a better retaining effect when an insulating panel is pushed in between the rafters. The winding capacity is not adversely affected thereby.

According to a preferred manufacturing method, the transverse marking lines are applied by the action of heat and a co-rotating roller disposed to rest on the top of the production strip, the surface of the roller having correspondingly strip-like heated zones. These heated zones can be, for instance, produced by projecting heated ribs on the roller or by some other means so that as it passes through the lowest position on the periphery of the roller, the heated zone makes direct contact with, or remains at a distance from, the surface of the mineral fibre sheet, the heat effect being generated locally. The production of tranverse markings in this way also has its own significance even independently of the method of installation according to the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
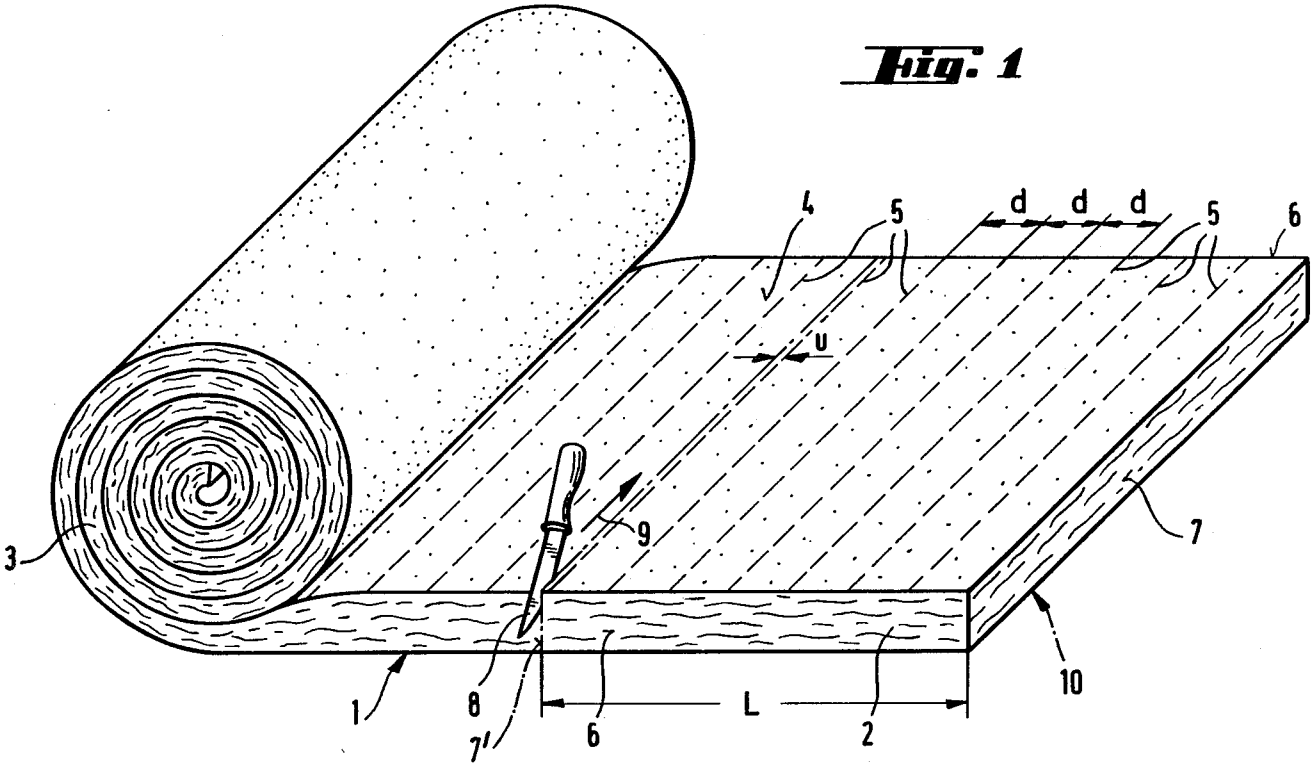
FIG. 1 is a perspective view of a roll of mineral fibre material with the end portion unrolled.

The mineral fibre strip 1 shown in FIG. 1, of which the leading end portion 2 is shown unrolled, shall for the sake of example be an unlined strip 1200 mm wide, with a nominal thickness of 100 mm and a length of 6 m. With a crude density of, for instance, 18 kg/cu.m and a phenol resin binder content of 6.6% by weight (dry), the resultant material falls within heat conductivity group 040.

Attention should be drawn to the fact that the position of the mineral fibre sheet 1 shown in FIG. 1 with the leading end portion 2 only partially unrolled would not arise in practice without the application retaining forces, since the internal stress of the roll resulting from winding is so great that when the covering is removed, the entire roll opens out and the mineral fibre strip 1 is in a completely extended condition, as is shown for the leading end portion 2 in the drawing. This is true not only because of the compression of the material in the rolled-up state, for instance in a ratio of 1:2.5, but also because of the resilience of the mineral fibre material itself. As can be seen from FIG. 1, when it is unrolled, the mineral fibre material opens out to its nominal thickness. During manufacture of the mineral fibre strip 1 on a production line, a thickness excess of about 10 mm is incorporated. After compression of this material in the roll over a prolonged period, it then springs open and recovers to its nominal thickness of, for example, 100 mm.

Applied to the surface 4 of the mineral fibre strip which is on the inside when it is rolled up are marking lines 5 which extend at a right-angle to the lateral edges 6 of the mineral fibre strip 1 and parallel with the front edge 7 thereof. In the example of the embodiment, let it be assumed that the marking lines 5 are applied at equal distances, the distance d between two adjacent marking lines being, for instance, 100 mm. As FIG. 1 illustrates, the marking lines need not be continuous lines but can instead be broken lines. What is however essential is that the marking lines 5 not be constituted by cuts, scores or the like, but that they should be purely visual and not notably influence the ease of handling and insulating efficiency of the material in the mineral fibre strip 1.

Figure 3:
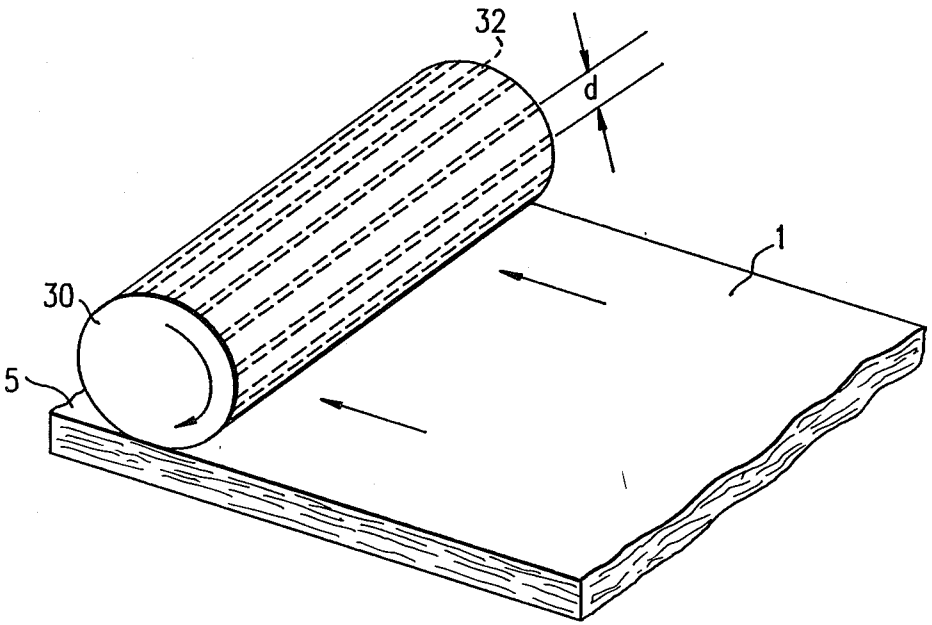
FIG. 3 is a schematic illustration of a roller forming marking lines.

FIG. 3 schematically illustrates the device for forming the transverse marking lines 5 on the mineral fibre sheet 1. A mineral fibre sheet 1 having a hardened binder is moved in the arrow direction. The top surface of the sheet 1 is contacted by the peripheral surface of a co-rotating roller 30. Strip like heating zones 32 are formed on the surface of the roller 30 which comes into contact with the sheet 1. The heating zones can be formed by any desired means, such as resistor heating elements embedded in the roller 30 or embedded in projecting ribs schematically shown by dashed lines. The heating zones are spaced by the same distance d so that as the roller surface rolls on the strip 1 with a pripheral speed equal to the moving speed of the sheet 1, the heat from the heating zones 32 form marks 5 having the same spacing.

Figure 2:
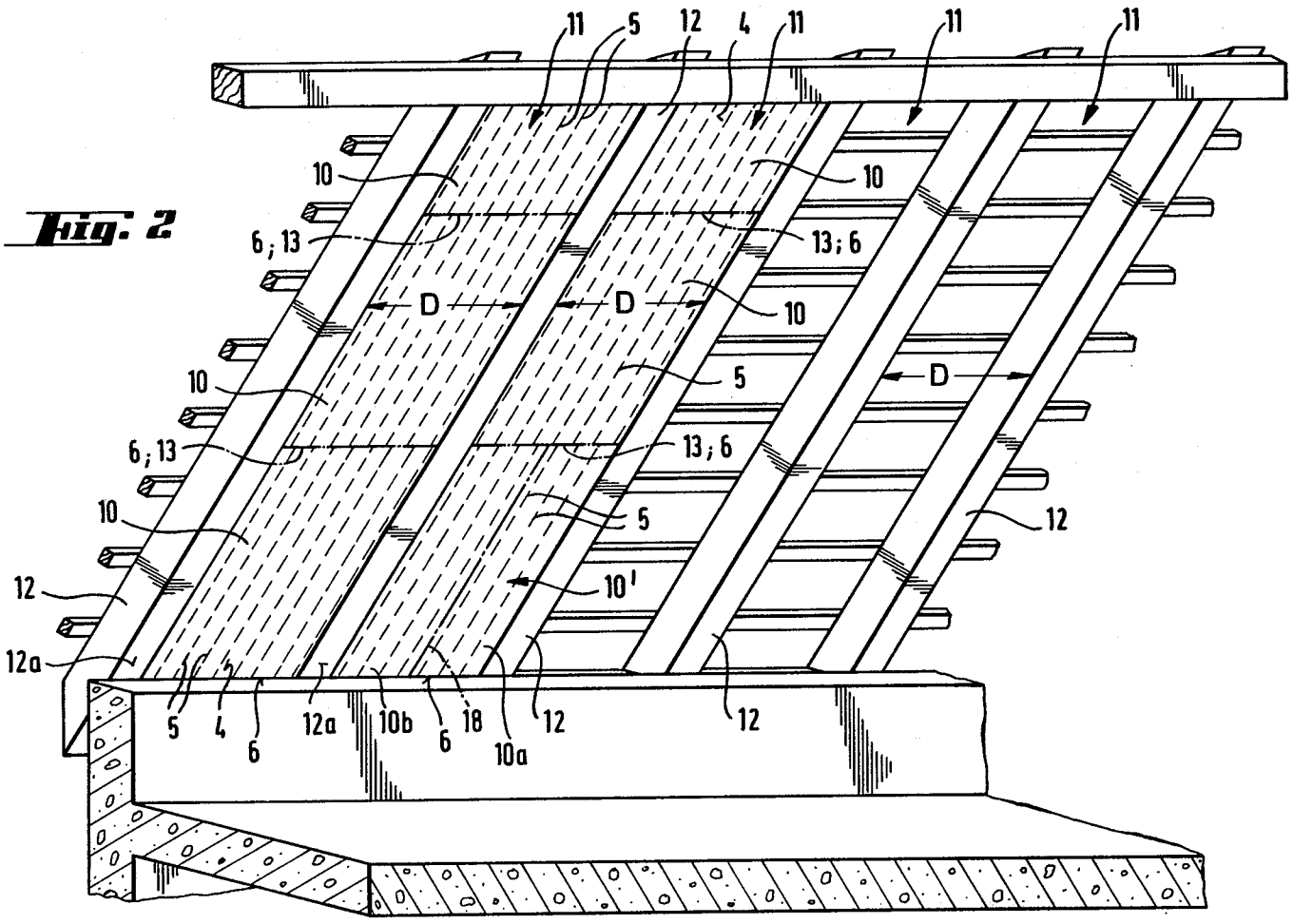
FIG. 2 is an illustration of the installation between rafters of the mineral fibre panels produced by cutting lengths from the strip of mineral fibre material.

In order to fill in a rafter area having a width D of, for example, 700 mm as shown in FIG. 2, a length portion L of, for example, 710 mm is measured out along the marking lines 5, starting from the leading edge 7, to allow for an oversize U of 10 mm, which is required to ensure contact pressure. The portion 2 is then cut off at 7'. To this end, in the manner shown in FIG. 1, a knife 8 is applied to the measured out cutting line and is drawn through the material in the direction of the arrow 9 and in parallel with the adjacent marking line 5.

Thus is formed a panel 10 of insulating material such as can be seen in FIG. 2. In order to fill the rafter area without sagging, the thus formed panel should have a stiffness sufficient to span a rafter spacing of 700 mm without sagging. The insulating panel 10 is turned by 90° so that what were previously the lateral edges 6 of the mineral fibre strip 1 are at the top and bottom, the length L determining the width of the mineral fibre panel 10. In this orientation the mineral fibre panel 10 is inserted into one of the rafter areas 11 between two adjacent rafters 12. The oversize U of the length portion L compared with the width D of the rafter area 11 at the point of installation, and amounting in the embodiment to 10 mm or a little more, ensures the desired contact pressure of the mineral fibre panel 10 with the rafter. After insertion between the rafters 12, the mineral fibre panel 10 is thus clamped-in.

The rafter areas 11 which are at the front in the drawing and which are already provided with mineral fibre panels 10, show that only a few (three in the embodiment) mineral fibre panels 10 are required per rafter area 11 for the latter to be completely insulated. In this case, it is firstly the bottom-most mineral fibre panel 10 which is inserted between the adjacent rafters 12 and—possibly after prior minimal cutting of the bottom edge of the mineral fibre panel 10 according to the construction of the bottom end of the rafter area 11—pressed down and pushed. Then the next mineral fibre panel 10 is inserted over the already installed mineral fibre panel 10, pressed in between the rafters 12 and pushed down so that it bears closely on the already installed mineral fibre panel 10. In this was, only a few movements are necessary for complete insulation of one rafter area 11. The transverse joint 13 indicated by dash-dotted lines and disposed between adjacent mineral fibre panels 10 is virtually unnoticeable from a distance when viewed with the naked eye. If, as illustrated, the mineral fibre panels 10 are installed with the marking lines 5 on the inside all that can be seen is that at this point there is an offset of marking lines 5. If necessry, of course, it is also possible to install the mineral fibre panels 10 with the marking lines 5 facing in the direction of the outside of the roof.

As FIG. 2 shows, the upper insulating panels 10 point towards the roof ridge and in the installed position they are of lesser length than the mineral fibre panels 10 below them, in the example of embodiment, half the length. For this purpose, the portions 2 from which the upper mineral fibre panels 10 are formed, have each been cut in half in a direction parallel with the lateral edges 6, so that the two cut parts of a single mineral fibre panel 10 of full height are sufficient to fill in two rafter areas 11 as far as the roof ridge without the need for any wastage. It goes without saying that any part which is no longer required in the first rafter area 11 could be used at the bottom of the second rafter area 11, the insulation being built up from that point, and it is quite clear that such a division of a mineral fibre panel 10 is also possible as a means for finishing off the ridge area, if only a very small or a very large piece of a complete panel is required to complete the insulation in the ridge area. All that is necessary is that somewhere another rafter area 11 of the same width be available and allowing for a negligible amount of wastage, the balance of the cut off mineral fibre insulating panel 10 can also be used for a rafter area 11 which is of a different width.

Similarly, at the end of the mineral fibre strip 1, after the last cut has been made, a portion 10*a* will be left, the length of which will be less than the width D of a rafter area 11 which is to be insulated. In this case, a complementary portion 10*b* can be cut from the next roll and joined with the remnant from the preceding roll to form an installation unit 10' which will once again have the dimensions desired of a mineral fibre panel 10 and which can be installed in exactly the same way as a one-piece mineral fibre panel 10. The longitudinal split 18 which occurs in this case is closed off fully by the pressure between the rafters 12.

Once all the rafter areas 11 have been filled with mineral fibre panels 10, a vapor barrier of polyethylene film can be applied all over, the individual strips being fixed, for example, transversely across the rafter areas 11 and on the inside faces 12*a* of the rafters 12, and possibly being sealed in the joint area by means of self-adhesive film.

In this way, starting with a mineral fibre strip 1 delivered in roll form and of appropriate consistency, it is possible to work virtually completely without wastage, regardless of whether the building involved is new and has very regular spaces between rafters or whether it is old with vastly differing gaps between rafters. The additional expense in the case of an old building lies only in increased measuring work; even there, material losses will not arise. The few mineral fibre panels 10 required per rafter area 11 can be produced by a few freehand cuts along the marking lines 5, the panels being inserted conveniently between the rafters 11 with one action, even when the installer is working alone. The panels have the effect of being clamped between the rafters, so that despite the requirement of accurately fitting mineral fibre panels 10, the labor costs are extremely low even if the distances between rafters vary greatly. From the point of view of manufacture, the mineral fibre strips 1 can be produced with existing production plants and winding machinery, a simple accessory arrangement being required in the form of a roller for producing the marking lines 5. Since it is possible to work with a single roll width, production and store-keeping are considerably simplified; also, prior to buying the insulating material, the buyer need not make any special measurements of all the distances between raters in order to prepare a list of the required quantities of mineral fibre material in the strip widths required. Instead, he can buy the necessary number of identical rolls according to the overall area to be insulated and can be sure of being able to insulate the roof of the indicated area without wastage.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of installing a mineral fibre material having a density of at least 10 $Kg/m^3$ and containing a binder in an elongate installation space bounded by two lateral roofing rafters, comprising the steps of:

unrolling a rolled up elongate strip of said mineral to result in an unrolled strip having a stiffness corresponding to that of a panel;

cutting from said strip an end portion having a length L equal to a width D of said installation space plus an over-measure, to form a stiff panel having a stiffness sufficient to span a rafter spacing of 700 mm without sagging;

orienting said stiff panel such that said length L is parallel to said width D of said installation space;

fitting said panel into said installation space with an interference fit due to said over-measure, whereby said panel is retained in said installation space in opposition to the weight of the material, only by the stiffness thereof; and repeating said separating orienting and fitting steps.

2. The method of claim 1 wherein said strip has visual marking lines on one surface and extending transverse to said length L, and wherein said cutting step comprises freehand cutting said strip using said marking lines as a guide, whereby said interference fit can be consistently assured.

3. The method of claim 1, wherein a final end portion of said strip having end portions previously separated according to said cutting step, has a length L less than said width D plus said over-measure, including the steps of:

cutting from a further unrolled strip of said material an end portion having a length L which, together with said length L of said final end portion equals said width D plus said over-measure;

orienting said final end portion and said end portion from said further strip such that their lengths are parallel to said width D; and fitting said final end portion and said end portion from said further strip together into said installation space as a single panel.

4. The method of claim 2, wherein a final end portion of said strip having end portions previously separated according to said separating step, has a length L less than said width D plus said over-measure, including the steps of:

cutting separating from a further unrolled strip of said material an end portion having a length L which, together with said length L of said final end portion equals said width L' plus said over-measure;

orienting said final end portion and said end portion from said further strip such that their lengths are parallel to said width D; and fitting said final end portion and said end portion from said further strip together into said installation space as a single panel.

5. The method of claim 1 wherein said installation space has a length unequal to a whole multiple of a width of said strip, including the steps of:

cutting from one of said panels a portion corresponding to an excess of a whole multiple of a width of said strip over said installation space length; and fitting said excess portion in another installation space with the same orientation as in said one of said panels.

6. The method of claim 2 wherein said installation space has a length unequal to a whole multiple of a width of said strip, including the steps of:

separating from one of said panels a portion corresponding to an excess of a whole multiple of a width of said strip over said installation space length; and fitting said excess portion in another installation space with the same orientation as in said one of said panels.

7. The method of claim 1, including the step of spanning a covering film over a plurality of said panels in said installation space and fixing said film to exposed faces of said rafters.

8. The method of claim 2 including the step of spanning a covering film over a plurality of said panels in said installation space and fixing said film to exposed faces of said rafters,

* * * * *